US007941987B1

(12) United States Patent
Raim

(10) Patent No.: US 7,941,987 B1
(45) Date of Patent: May 17, 2011

(54) TILE SPACER AND METHOD FOR ITS USE

(76) Inventor: Michael E. Raim, Destin, FL (US)

( * ) Notice: Subject to any disclaimer, the term of this patent is extended or adjusted under 35 U.S.C. 154(b) by 213 days.

(21) Appl. No.: 12/321,876

(22) Filed: Jan. 26, 2009

(51) Int. Cl.
*E04B 1/00* (2006.01)

(52) U.S. Cl. ..... 52/747.11; 52/749.11; 33/526

(58) Field of Classification Search ..... 52/384, 52/345, 747.11, 749.11, 793.1, 793.11; 33/526, 33/527, 501.45, 613, 567
See application file for complete search history.

(56) References Cited

U.S. PATENT DOCUMENTS

| | | | | |
|---|---|---|---|---|
| 2,466,919 | A | 4/1949 | Syjes | |
| 2,930,135 | A | 3/1960 | Rodtz, Sr. | |
| 3,254,417 | A | 6/1966 | Carmichael, Sr. | |
| 3,548,505 | A | 12/1970 | Candilo | |
| 3,735,497 | A | 5/1973 | Boettcher | |
| 4,736,562 | A * | 4/1988 | Kelly | 52/173.1 |
| 4,793,068 | A | 12/1988 | Golkar | |
| 4,908,952 | A * | 3/1990 | Joos | 33/526 |
| 5,010,654 | A | 4/1991 | Funes, Jr. | |
| 5,201,130 | A | 4/1993 | Krchnak | |
| 5,359,783 | A | 11/1994 | Smith | |
| 5,806,264 | A * | 9/1998 | Boot | 52/415 |
| 5,972,475 | A * | 10/1999 | Beekman | 428/167 |
| 6,067,764 | A * | 5/2000 | Johansen | 52/302.1 |
| 6,354,058 | B1 * | 3/2002 | Lewis | 52/749.11 |
| 6,357,185 | B1 * | 3/2002 | Obermeyer et al. | 52/95 |
| 6,754,972 | B2 | 6/2004 | Donnellan | |
| 6,759,114 | B2 * | 7/2004 | Wu et al. | 428/178 |
| 7,641,954 | B2 * | 1/2010 | Rouanet et al. | 428/76 |
| 2007/0214743 | A1 * | 9/2007 | Alvarez | 52/749.11 |

* cited by examiner

*Primary Examiner* — Basil Katcheves
*Assistant Examiner* — Branon C Painter
(74) *Attorney, Agent, or Firm* — Peter Loffler

(57) ABSTRACT

A tile spacer is made from a pair of parallel planar members joined by a series of connectors forming a series of channels. The tile spacer is positioned between two adjacent tiles and sunk into the adhesive so that excess adhesive enters the channels and is subsequently removed. One or more appropriate cuts can be made to the tile spacer in order to open desired channels which allows the tile spacer to curve or otherwise bend from linear.

7 Claims, 4 Drawing Sheets

TILE SPACER AND METHOD FOR ITS USE

BACKGROUND OF THE INVENTION

1. Field of the Invention

The present invention relates to an inexpensive tile spacer for maintaining uniform spacing between tiles and the associated method for the tile spacer's use.

2. Background of the Prior Art

Laying tile, while appearing to be relatively simple and straightforward to those who have never attempted a tile job, is a rather difficult task that requires a relatively high level of skill to accomplish properly. One of the most critical elements of the tile job is the need to properly space the tilts from one another. If the tiles are not spaced uniformly throughout the tile job, the finished product will have an unsatisfactory appearance, even upon casual observation.

Recognizing the need to have stubbornly uniform spacing between tiles, tile installers use spacing tools that help achieve this result. These tools, which come in varying architectures, help maintain the desired uniformity between the tiles and thereby achieve a more aesthetic end product. As the is being laid, the spacers are placed between adjoining tiles and left thereat until the mastic begins to set up, whereupon the spacers are removed. While effective, these tools have certain shortcomings.

While each individual spacer may be relatively inexpensive, typically several dozen such tools are needed on a given job due to the fact that the spacers must remain in position during mastic set up. This makes obtaining a working set of spacers a costly endeavor especially in light of the fact that many sets are needed due to differing inter-tile spacings on different jobs. Additionally, the present spacers, typically made from a hard plastic or metal, can only be used on straight tile alignments and cannot be used on curves or other complex non-linear tile layouts. Additionally, many prior art devices are too heavy to be used when laying tile on a vertical surface.

What is needed is a tile spacer that addresses the above mentioned shortcomings found in the art. Such a tile spacer must be of relatively inexpensive design and construction so that a proper working set can be obtained relatively inexpensively. Such a device must allow for use on curved or other complex layouts and must allow for proper tile alignment on both horizontal and vertical surfaces.

SUMMARY OF THE INVENTION

The tile spacer and method for its use of the present invention address the aforementioned needs in the art by providing a tool that allows for proper tile alignment on both horizontal and vertical surfaces. The tile spacer, being relatively simple in design and construction, is relatively inexpensive to produce. This makes a proper working set of the tile spacers relatively inexpensive for potential buyers of the tool, even in multiple gauges of spacing. The present invention is capable of aligning tiles that have a curved or other complex layout and can be produced in a variety of gauges to allow for various inter-tile spacings.

The tile spacer and method for its use of the present invention is comprised of a body member that has a first planar member having a first outer surface and a first inner surface and a second planar member having a second outer surface and a second inner surface. The first inner surface is joined with the second inner surface by a series of connectors such that the series of connectors, the first inner surface, and the second inner surface form a series of closed channels open on each end. The first planar member and the second planar member are generally parallel with one another. The body member also has a first edge and a second edge. The first edge of the body member is inserted into the adhesive toward the base upon which the tile is being laid between the first tile and the second tile allowing excess adhesive to enter the channels on each channel's open end at that edge. The first tile is abutted against the first outer surface while the second tile is abutted against the second outer surface. After passage of a sufficient amount of time, the body member is removed from the spacing between the first tile and the second tile. At least the first edge of the body member is straight. The body member may be made from plasticized cardboard. The first outer surface and the second outer surface of the body member are each flat. The body member may be flexed into a curved or other non-linear orientation by opening at least one of the channels by cutting the first planar member completely from the first edge to the second edge at the respective channel (between the two open ends of the channel). If the body member is of sufficient size between the first edge and the second edge, the body member is cut along its entire length on a line that is parallel to the first edge in order to form a first section of the body member and a detached second section of the body member (which may be used elsewhere on the job), immediately after the step of providing the body member (prior to adhesive insertion).

BRIEF DESCRIPTION OF THE DRAWINGS

Similar reference numerals refer to similar parts throughout the several views of the drawings.

DESCRIPTION OF THE PREFERRED EMBODIMENT

Figure 1:
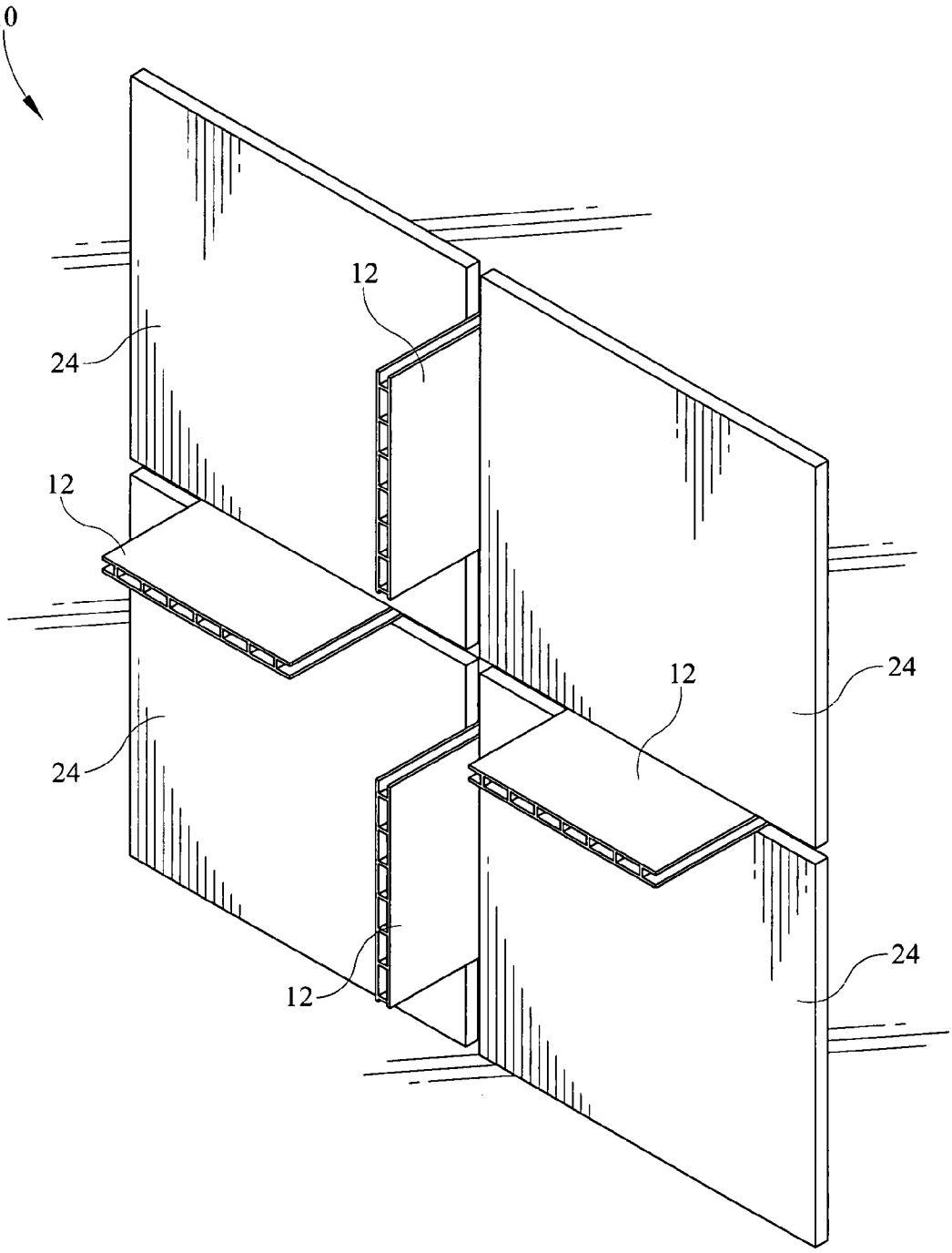
FIG. 1 is an environmental view of several tile spacers of the present invention being used to align tiles on a vertical surface.
Figure 2:
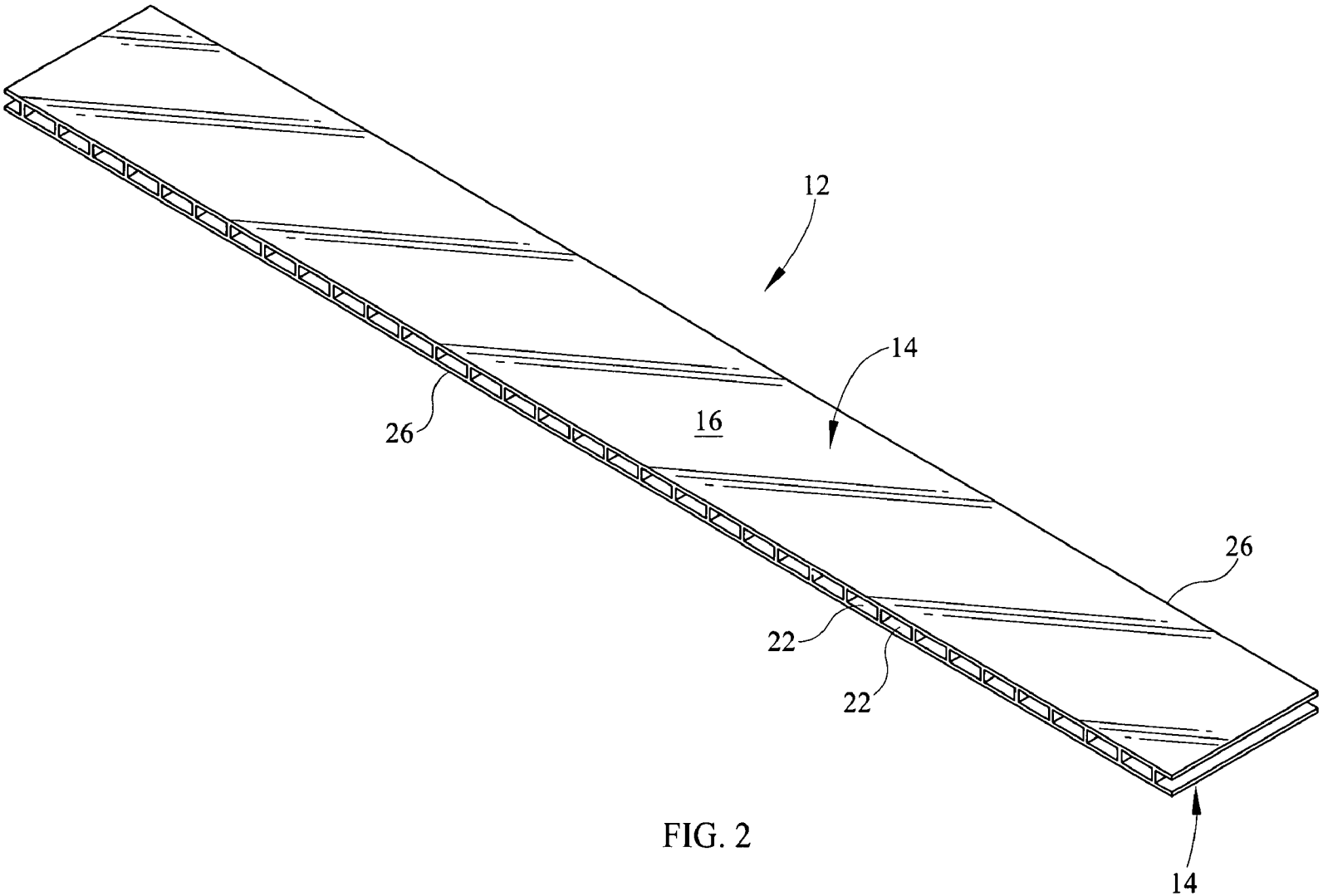
FIG. 2 is a perspective view of the tile spacer.

Referring now to the drawings, it is seen that the tile spacer and method for its use of the present invention, generally denoted by reference numeral 10, is comprised of a body member 12 that is formed from a pair of generally coextensive parallel planar members 14, each having an outer surface 16 that is generally flat. A series of connectors 18 connect the inner surfaces 20 of the planar members 14 thereby forming a series of channels 22, the channels 22 closed along their sides and open at their ends (although only one end needs to be open). The body member 12 is made from either plastic, plasticized cardboard or similar material. The body member 12 may be of unitary construction (and may, but need not be monolithic) and may be formed by an extrusion process. A single relatively large sheet of the body member 12 may be obtained (for example, a four foot by four foot sheet) and thereafter cut into individual tile spacers 10 using shears, a knife, etc. The length of the connectors 18 and thickness of the planar members 14 (the width of the spacer 10) determine the amount of spacing between tiles 24 that is achieved by the device 10. Although the connectors 18 are illustrated as being parallel to one another and generally normal to the planar members 14, forming generally rectangular channels 22, the connectors may also have other alignments such as a diagonal see-saw pattern, honeycomb pattern (neither illustrated), etc., so long as channels having at least one end open are formed between the planar members 14.

Figure 3:
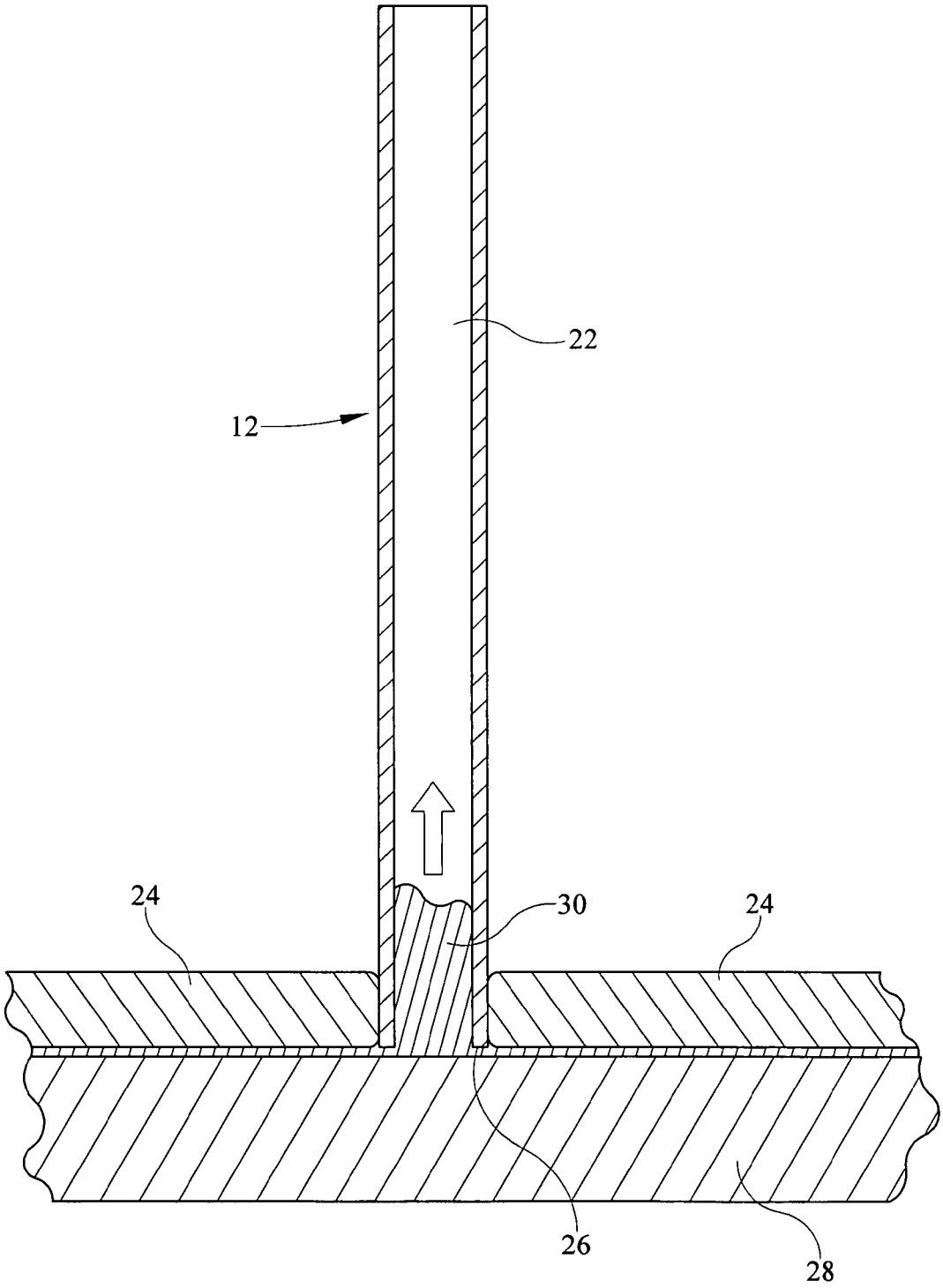
FIG. 3 is a sectioned environmental view of the tile spacer aligning tiles.
Figure 4:
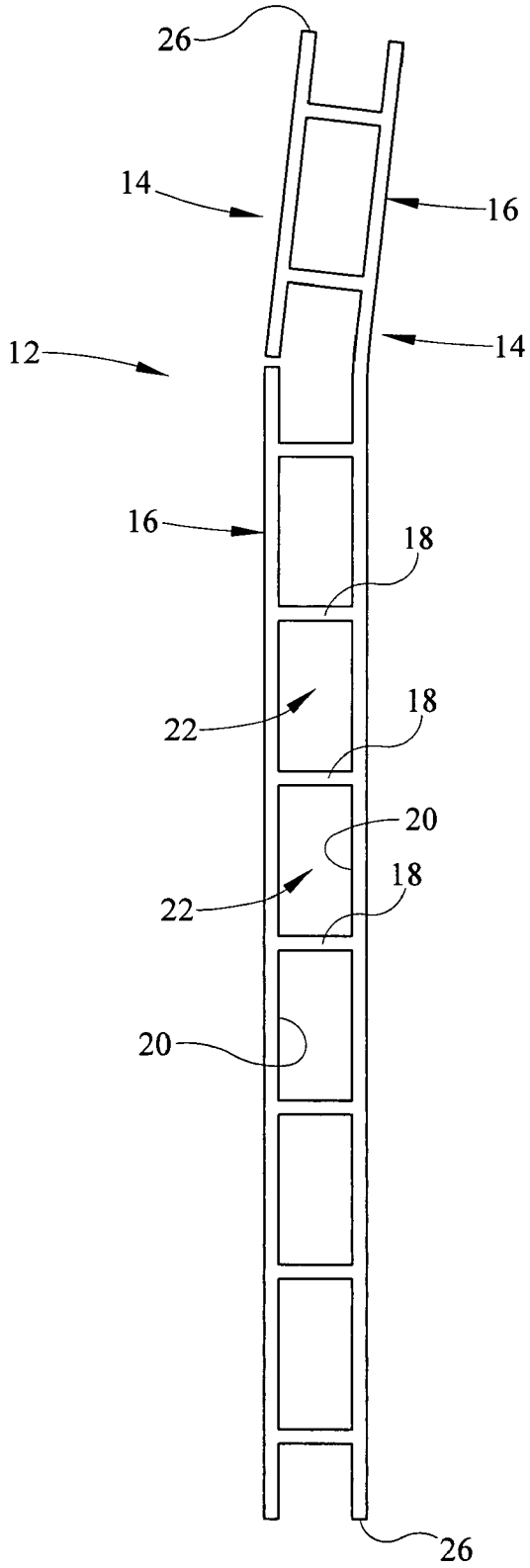
FIG. 4 is a side view of the tile spacer.

In order to use the tile spacer 10, several such spacers 10 having the desired width are obtained for the tile job at hand. If the body member 12 is a single large sheet, individual spacers 10 are cut as needed, it being important that the edge 26 of the spacer 10 that is facing the base 28 upon which the tile 24 is to be laid is straight in order to get a good fit. The desired adhesive 30 is placed onto the base 28 in normal fashion and the tile 24 is laid, again in normal fashion. A tile spacer 10 is sunk into the adhesive 30 toward the base 28 between to adjacent tiles 24 and the two tiles 24 are each pushed so as to abut against a respective one of the outer surfaces 16 of a planar member 14. As seen in FIG. 3, excess adhesive 30 is pushed up into the channels 22 of the tile spacer 10 through the open end that is being pressed into the adhesive 30 and not onto the upper surface of the tiles 24. Once the adhesive 30 is sufficiently set, the tile spacers 10 are removed from their respective positions, the relatively slick nature of the material that forms the outer surfaces 16 allows for relatively easy removal and allows for a longer set-up period of the adhesive 30 relative to spacers that have a higher coefficient of friction which may be important in vertical tile jobs. If desired, the coefficient of friction can be reduced even more by putting a coating of non-slip material such as polytetrafluoroethene (PTFE), silicone, etc., onto the outer surfaces 16. The excess adhesive 30, by being in the channels 22, is removed from the tile job upon removal of the tile spacer 10. If a water-based mortar or adhesive 30 is being used, the tile spacers 10 can be soaked in water and thereafter rinsed in order to remove the adhesive 30 allowing the tile spacer 10 to be reused.

On curved or other non-linear spacings, one or more of the channels 22 are opened by cutting one of the planar members 14 from edge 26 to edge 26. The tile spacer 10, by being flexible, is curved as needed with the opened channels 26 allowing the tile spacer 10 to span in the direction of the curve. In a multi-curved application, multiple channels 22 may be opened with both planar members 14 cut in order to allow the tile spacer 10 to "snake" with the tiles 24.

While the invention has been particularly shown and described with reference to an embodiment thereof, it will be appreciated by those skilled in the art that various changes in form and detail may be made without departing from the spirit and scope of the invention.

I claim:

1. A method of aligning the spacing between a first tile and a second tile each laid on wet adhesive all on a base, the method comprising the steps of:

providing a body member that has a first planar member having a first outer surface and a first inner surface, the body member also having a second planar member that has a second outer surface and a second inner surface, the first inner surface joined with the second inner surface by a series of connectors, the series of connectors, the first inner surface, and the second inner surface forming a series of channels, the first planar member and the second planar member being parallel with one another, the body member having a first edge and a second edge;

inserting the first edge of the body member into the adhesive toward the base and between the first tile and the second tile allowing excess adhesive to enter the channels;

abutting the first tile against the first outer surface;

abutting the second tile against the second outer surface; and removing the body member from the spacing between the first tile and the second tile.

2. The method as in claim 1 wherein the first edge is straight.

3. The method as in claim 1 wherein the body member is made from plasticized cardboard.

4. The method as in claim 1 wherein the first outer surface and the second outer surface are each flat.

5. The method as in claim 1 wherein the body member is curved and one of the channels is opened by cutting the first planar member completely from the first edge to the second edge at the respective one channel.

6. The method as in claim 1 wherein the body member is cut along its entire length on a line that is parallel to the first edge in order to form a first section of the body member and a detached second section of the body member, immediately after the step of providing the body member.

7. The method as in claim 1 wherein the first outer surface and the second outer surface are each coated with a non-slip material.

* * * * *